US006377239B1

(12) United States Patent
Isikawa

(10) Patent No.: US 6,377,239 B1
(45) Date of Patent: Apr. 23, 2002

(54) MULTIDIRECTIONAL INPUT DEVICE

(75) Inventor: Sinzi Isikawa, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/318,666

(22) Filed: May 25, 1999

(30) Foreign Application Priority Data

May 26, 1998 (JP) ..... 10-144375

(51) Int. Cl.[7] ..... G09G 5/00

(52) U.S. Cl. ..... 345/156; 345/161; 200/5 R; 200/6 R

(58) Field of Search ..... 345/156, 157, 345/161; 200/5 R, 6 R

(56) References Cited

U.S. PATENT DOCUMENTS

| | | | | |
|---|---|---|---|---|
| 4,500,867 A | * | 2/1985 | Ishitobi et al. | 200/4 R |
| 4,784,008 A | * | 11/1988 | Paquereau et al. | 74/471 |
| 5,459,292 A | * | 10/1995 | Nagano et al. | 200/4 R |
| 5,607,049 A | * | 3/1997 | Shioda | 200/557 |
| 5,665,946 A | * | 9/1997 | Nishijima et al. | 200/4 |
| 5,689,095 A | * | 11/1997 | Kawase | 200/5 R |
| 6,189,401 B1 | * | 2/2001 | Atwell et al. | 74/471 XY |

FOREIGN PATENT DOCUMENTS

| | | |
|---|---|---|
| DE | 2108912 | 10/1972 |
| DE | 44 43 726 A1 | 6/1995 |
| DE | 44 10 201 A1 | 9/1995 |
| DE | 3426922 A1 | 1/1996 |
| DE | 198 29 811 A1 | 2/1999 |
| EP | 0 632 475 A1 | 1/1995 |
| JP | 7-235241 | 9/1995 |
| JP | 7-245042 | 9/1995 |

* cited by examiner

*Primary Examiner*—Richard Hjerpe
*Assistant Examiner*—Kimnhung Nguyen
(74) *Attorney, Agent, or Firm*—Brinks Hofer Gilson & Lione

(57) ABSTRACT

A multidirectional input device includes a control lever held to tilt; a flange member to be tilted by tilting of the control lever, and not to turn (upper movable contact plate); a support member (cover member) opposed to the flange member so as not to tilt and turn; a first switch having a first fixed contact to be turned on/off in response to contact and separation between the first fixed contact and the flange member according to tilting of the control lever in a first tilting direction; and a second switch having a second fixed contact to be turned on/off in response to contact and separation between the second fixed contact and the flange member according to tilting of the control lever in a second tilting direction. The control lever brings an end portion of the flange member into contact with the support member, and tilts on the end portion. When the first switch and the second switch are simultaneously turned on/off by tilting of the control lever, the inclined flange member and the support member are brought into line contact or two-point contact with each other.

17 Claims, 17 Drawing Sheets

MULTIDIRECTIONAL INPUT DEVICE

BACKGROUND OF THE INVENTION

1. Field of the Invention

The present invention relates to a multidirectional input device in which switches can be actuated according to the arbitrary tilting direction of a control lever.

2. Description of the Related Art

As disclosed in Japanese Patent Application Laid-Open No. 7-235241, a multidirectional input device has been proposed hitherto, which roughly comprises a housing having an open top face, a cover member disposed at the open end of the housing, a switch element held inside the housing, and a control lever for actuating the switch element.

The switch element is constituted by a center fixed contact, a plurality of peripheral fixed contacts, a common contact, and a movable contact plate that are provided on the inner bottom face of the housing. The movable contact plate is always in contact with the common contact, and is apart from the center fixed contact and the peripheral fixed contacts.

The control lever is held inside the housing so as to tilt, and the top thereof projects from the cover member to the outside. The control lever is provided with a flange portion that includes a plurality of fulcrum portions facing the lower surface of the cover member, and an elastic portion formed outside the fulcrum portions.

In this multidirectional input device, when the control lever is in a neutral position, the movable contact plate is separate from the center fixed contact and the peripheral fixed contacts, and a switch-off state is obtained. When the control lever is tilted in an arbitrary direction, since it tilts on a fulcrum portion disposed on the opposite side from the tilting direction, the elastic portion positioned in the tilting direction presses the peripheral edge of the movable contact plate, and the bottom end of the control lever presses the center of the movable contact plate. Since the peripheral fixed contact positioned in the tilting direction and the center fixed contact are thereby electrically connected via the movable contact plate, a switch-on state is obtained. Therefore, even if the movable contact plate is not in contact with the center fixed contact when it is brought into contact with the peripheral fixed contact by tilting the control lever in the arbitrary direction, the elastic portion is further bent so as to bring the movable contact plate into contact with the center fixed contact.

In this multidirectional input device, however, since the movable contact plate is brought into contact with the peripheral fixed contact by the elastic portion of the control lever, it is impossible to increase the contact pressure of the movable contact plate on the peripheral fixed contact, which results in defective continuity. Moreover, a center fixed contact, and a plurality of peripheral fixed contacts surrounding the center fixed contact must be provided on the inner bottom face of the housing, and a large space is needed to place these fixed contacts therein. This enlarges the housing, and hinders size reduction of the device.

In order to eliminate the above disadvantages, the present applicant has proposed a multidirectional input device disclosed in the specification and the drawings of Japanese Patent Application No. 9-178324. FIG. 17 is a sectional view of this multidirectional input device, FIG. 18 is a top view of a drive member and an upper movable contact in the multidirectional input device, and FIG. 19 is a bottom view of a cover member in the multidirectional input device.

This multidirectional input device comprises a housing 101 and a cover member 102 that define a storage space 100, a control lever 103 held inside the storage space 100 so as to tilt, and projecting from the cover member 102, a lower fixed contact 104 in the housing 101, a lower movable contact plate 105 opposed to the lower fixed contact 104, upper fixed contacts 106*a* to 106*h* arranged on the cover member 103 at regular intervals in the circumferential direction (see FIG. 19), an upper movable contact plate 107 having a nearly circular outline and placed to face the upper fixed contacts 106*a* to 106*h*, and a coil spring 108 for pressing the upper movable contact plate 107 against the upper fixed contacts 106*a* to 106*h*.

Referring to FIG. 17, the multidirectional input device further comprises a drive member 109 for supporting the upper movable contact plate 107, a connecting member 110 for connecting the housing 101 and the cover member 102, and a common contact 111.

When the control lever 103 is tilted, as shown in FIG. 17, the lower movable contact plate 105 makes contact with the lower fixed contact 104, and the upper movable contact plate 107 inclines on one or two of the upper fixed contacts 106 to separate from the other upper fixed contacts 106. Oblique lines in FIG. 17 show the state of continuity among the members, the upper fixed contacts 106—the upper movable contact plate 107—the coil spring 108—the common contact 111—the lower movable contact plate 105—the lower fixed contact 104.

The above-described configuration ensures reliable contact and separation between the lower movable contact plate 105 and the lower fixed contact 104, and reliable contact and separation between the upper movable contact plate 107 and the upper fixed contacts 106*a* to 106*h*, thereby avoiding defective continuity. Furthermore, since the lower fixed contact 104 and the upper fixed contacts 106*a* to 106*h* are mounted on separate members, it is possible to reduce the size of the multidirectional input device.

In this multidirectional input device, the eight upper fixed contacts 106*a* to 106*h* are arranged on the outer periphery of the cover member 102, as shown in FIG. 19, to respond to tilting of the control lever 103 in various directions. In order to reduce the number of components, it may be possible to omit the fixed contacts 106*b*, 106*d*, 106*f*, and 106*h* that are disposed in the oblique directions. In this case, for example, when the control lever 103 is tilted in the oblique direction, as shown by the arrow of FIG. 19, the movable contact plate 107 simultaneously makes contact with the fixed contacts 106*e* and 106*g* on both sides of the fixed contact 106 because the fixed contact 106 does not exist. When these two switches are simultaneously turned on, it is determined that the control lever 103 has been tilted in the direction of the arrow.

Since the movable contact plate 107 in this multidirectional input device has a nearly circular outline, as shown in FIG. 18, however, when it is inclined by tilting of the control lever 103, as shown in FIG. 17, the end thereof is in one-point contact with the lower surface of the cover member 102. For this reason, the control lever 103 can simultaneously and reliably turn both the switches on only within a narrow range. A dead region, where the switches are not turned on, is produced, which lowers detection accuracy in the oblique directions.

SUMMARY OF THE INVENTION

In order to solve the above problems, it is an object of the present invention to provide a reliable multidirectional input device in which detection accuracy in oblique directions is high.

According to an aspect of the present invention, there is provided a multidirectional input device including a control lever held to tilt and not to turn; a conductive flange member to be tilted by tilting of the control lever, and not to turn, such as an upper movable contact plate;.a support member opposed to the flange member so as not to tilt and turn, such as a cover member having fixed contacts arranged in the circumferential direction; a first switch having a first fixed contact to be turned on/off in response to contact and separation between the first fixed contact and the flange member according to tilting of the control lever in a first tilting direction, the first switch being constituted by, for example, the first fixed contact and the upper movable contact plate; and a second switch having a second fixed contact to be turned on/off in response to contact and separation between the second fixed contact and the flange member according to tilting of the control lever in a second tilting direction, wherein the control lever brings an end portion of the flange member into contact with the support member, and tilts on the end portion, and wherein the inclined flange member and the support member are brought into line contact or two-point contact when the first switch and the second switch are simultaneously turned on/off by tilting of the control lever.

As described above, in the present invention, when the first switch and the second switch are simultaneously turned on/off by tilting of the control lever, the inclined flange member and the support member make line contact or two-point contact with each other. In process of tilting, the operation shaft of the control lever is naturally corrected to a direction such that it is stabilized. As a result, it is possible to simultaneously turn the first switch and the second switch on/off, and to thereby provide a reliable multidirectional input device in which detection accuracy in oblique directions is high.

Further objects, features, and advantages of the present invention will become apparent from the following description of the preferred embodiments with reference to the attached drawings.

DESCRIPTION OF THE PREFERRED EMBODIMENTS

Figure 1:
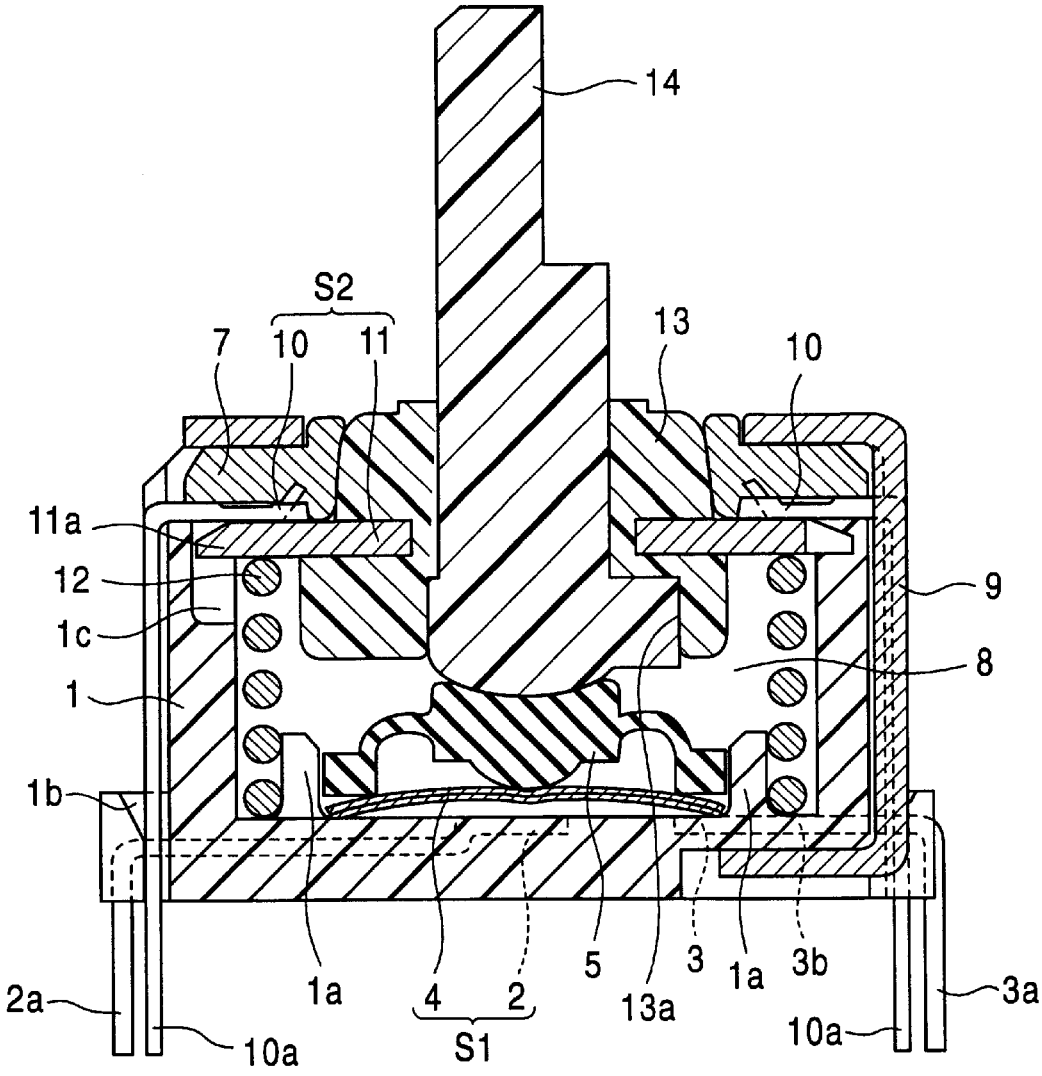
FIG. 1 is a sectional view of a multidirectional input device in a non-operation state according to a first embodiment of the present invention.
Figure 3:
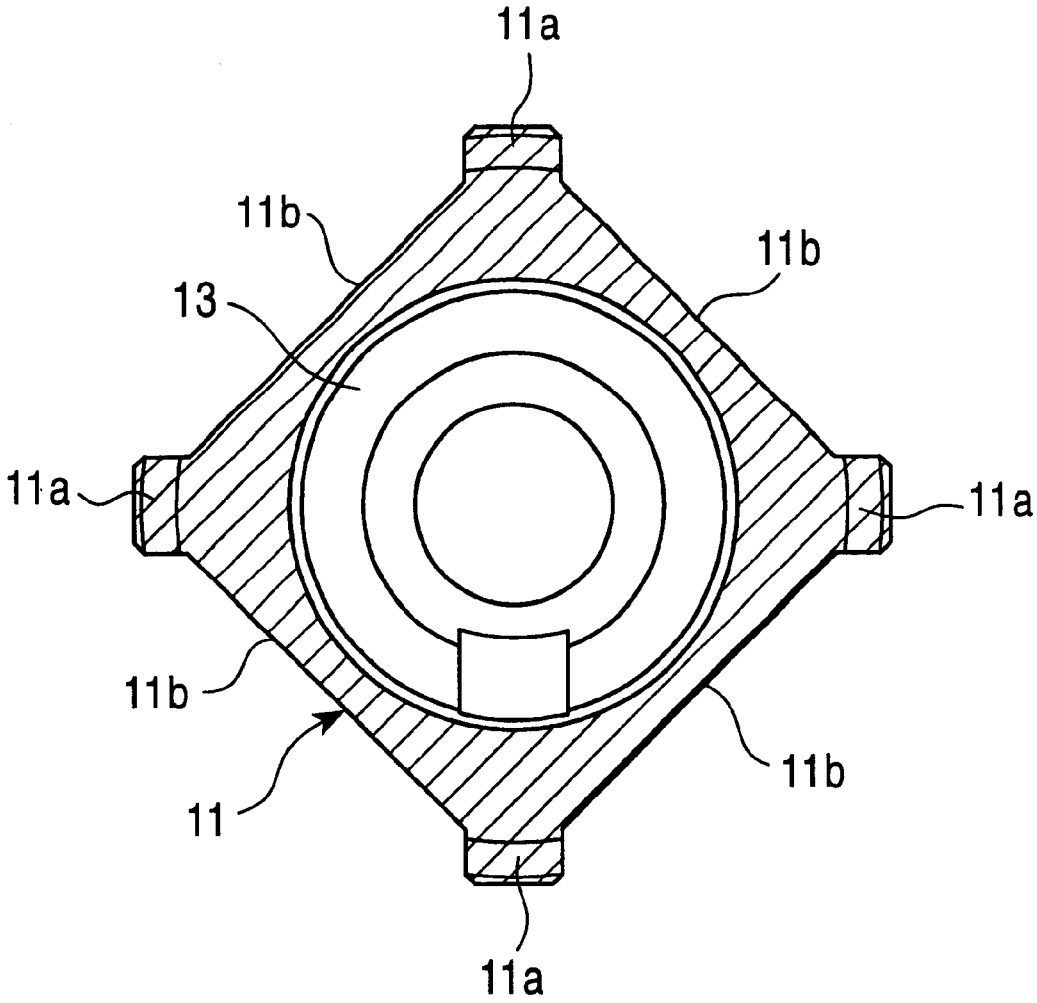
FIG. 3 is a top view of an upper movable contact plate in the multidirectional input device.
Figure 4:
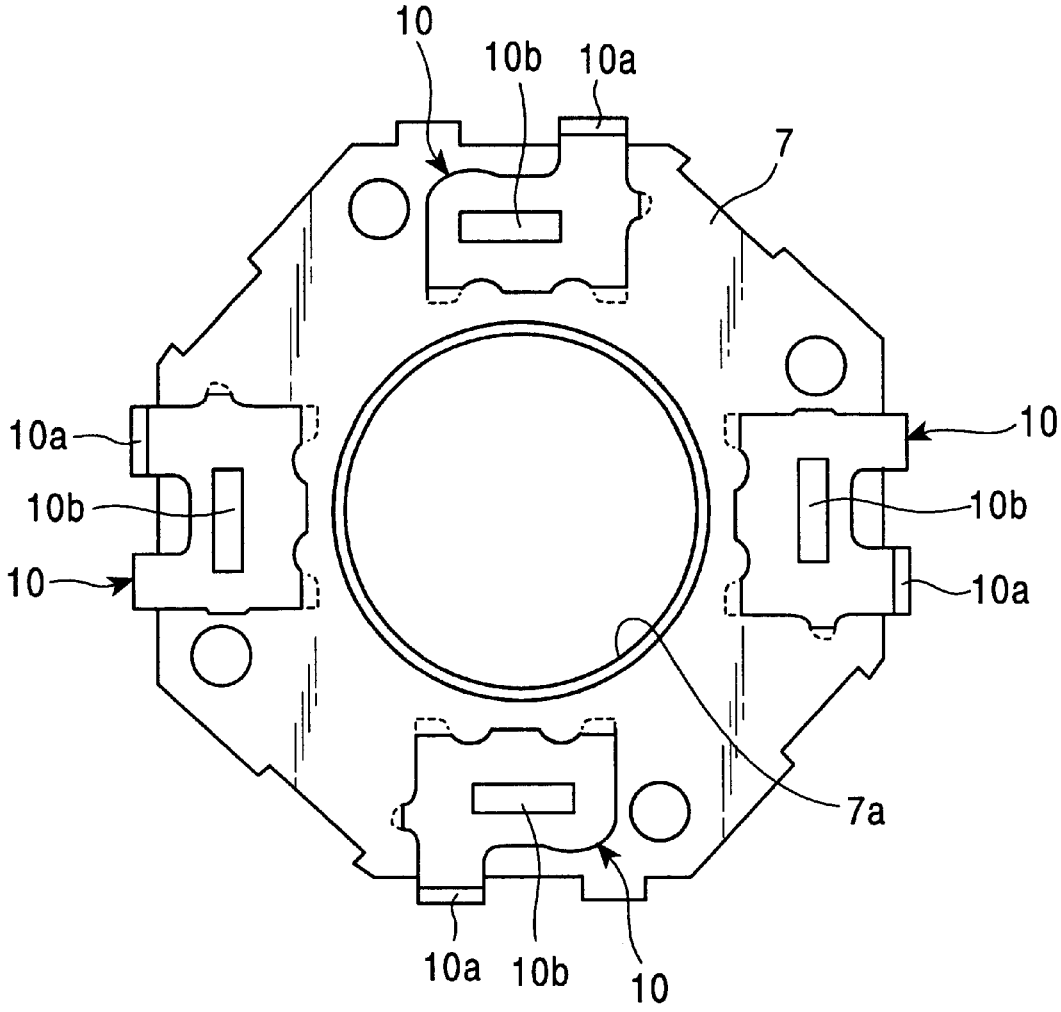
FIG. 4 is a bottom view of a cover member for holding upper fixed contacts in the multidirectional input device.
Figure 5:
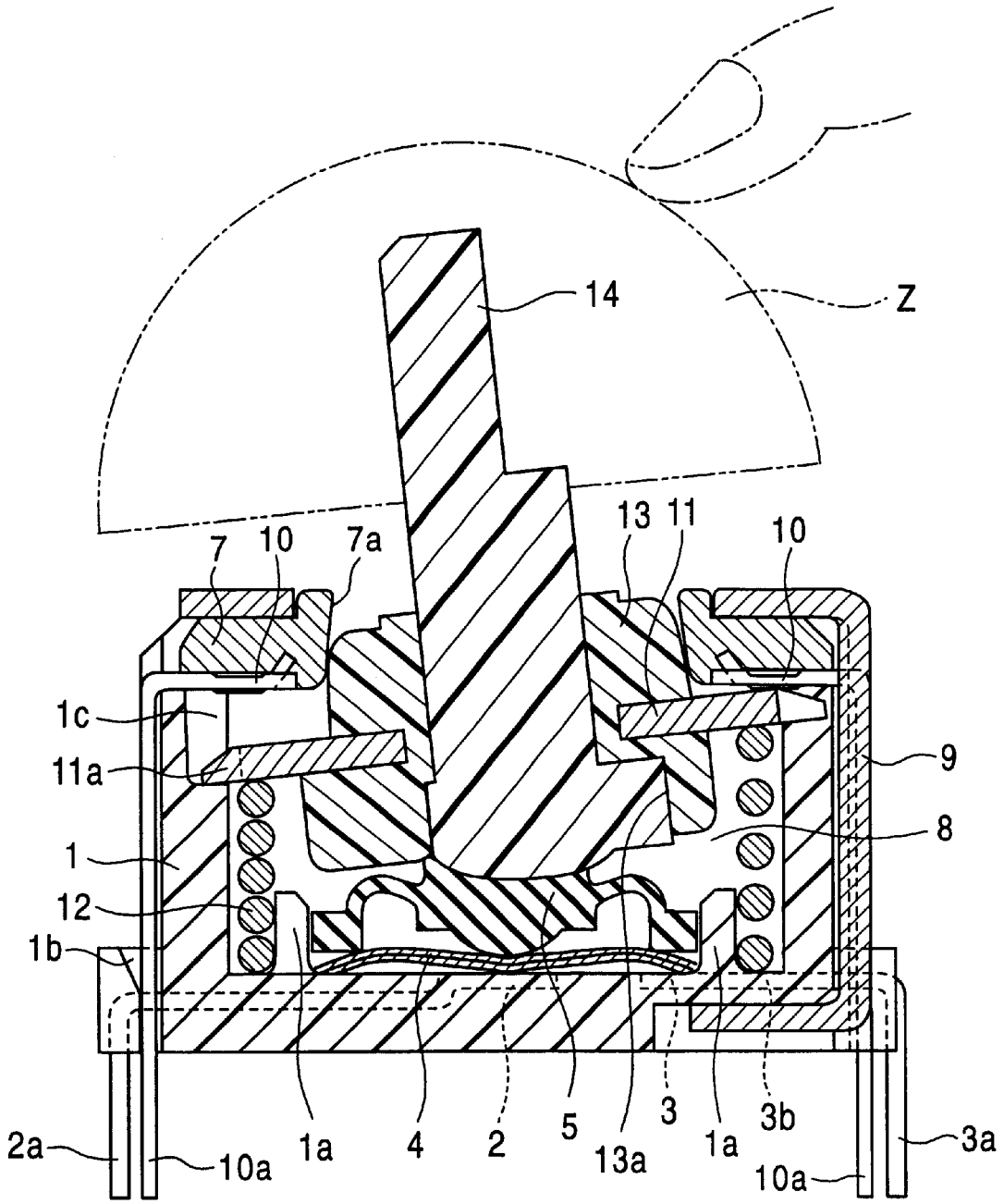
FIG. 5 is a sectional view showing a tilting operation in the multidirectional input device.
Figure 6:
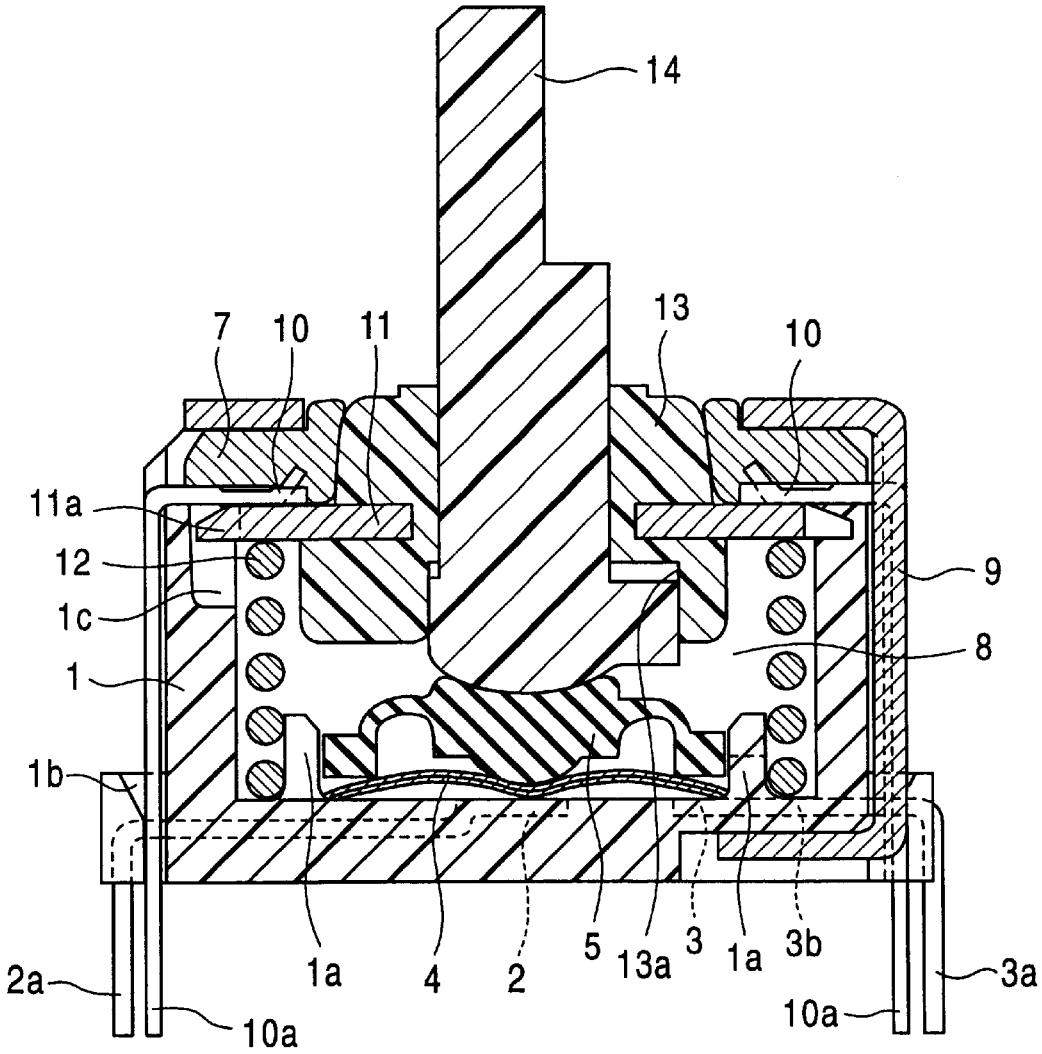
FIG. 6 is a sectional view showing a pushing operation in the multidirectional input device.
Figure 7:
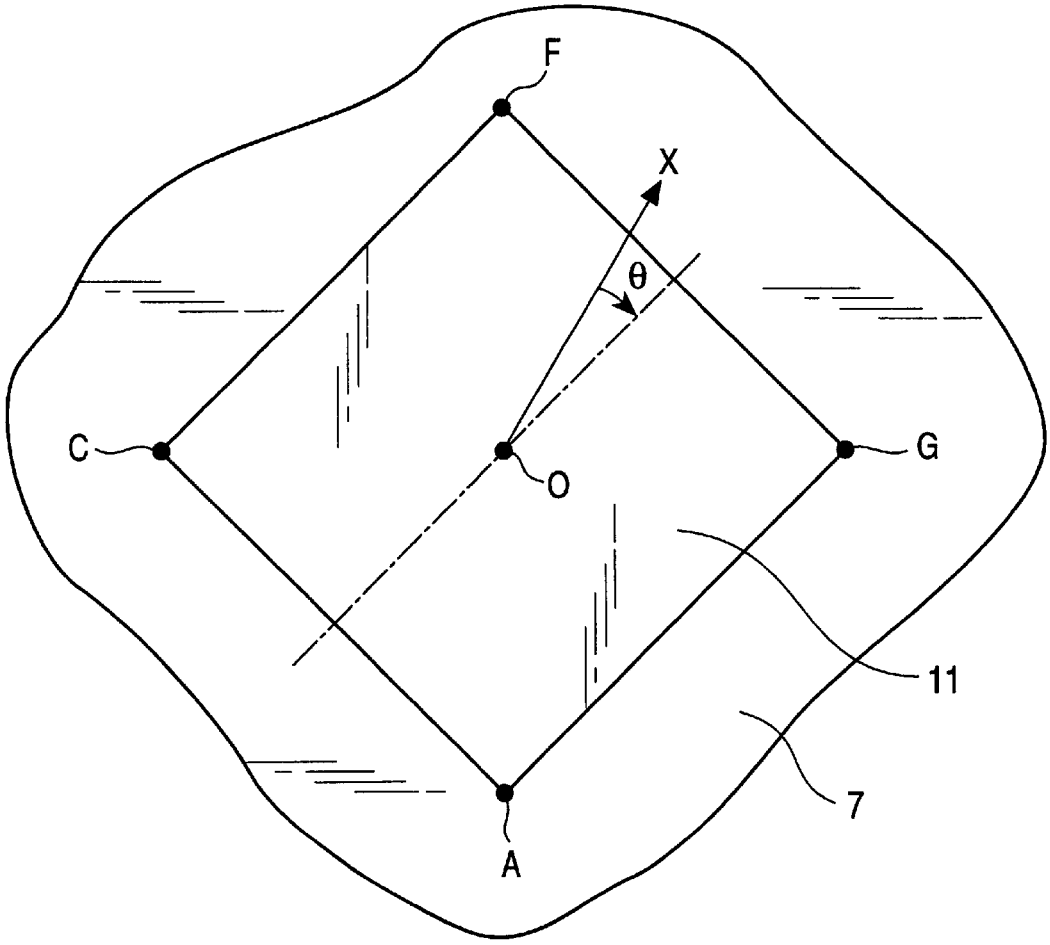
FIG. 7 is an explanatory diagram illustrating the operation principle of the multidirectional input device.
Figure 8:
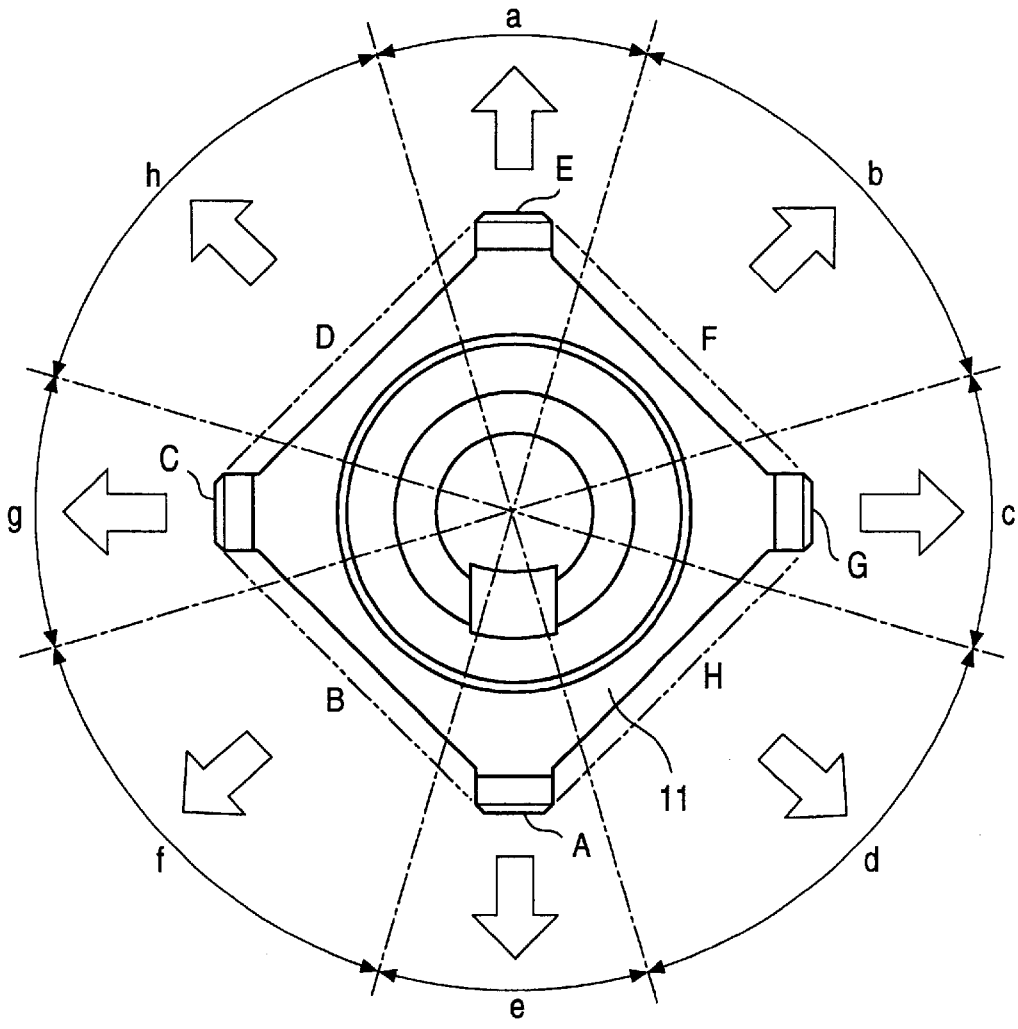
FIG. 8 is an explanatory diagram illustrating the relationship between the tilting direction of a control lever and the contact position in the multidirectional input device.

The preferred embodiments of the present invention will be described below with reference to the attached drawings. FIG. 1 is a sectional view of a multidirectional input device in a non-operation state according to a first embodiment of the present invention, FIG. 2 is a top view of a housing in the multidirectional input device, FIG. 3 is a top view of an upper movable contact plate, FIG. 4 is a bottom view of a cover member having upper fixed contacts mounted thereon, FIG. 5 is a sectional view showing a tilting operation in the multidirectional input device, FIG. 6 is a sectional view showing a pushing operation in the multidirectional input device, FIG. 7 is an explanatory diagram illustrating the operation principle of the multidirectional input device, and FIG. 8 is an explanatory diagram illustrating the relationship between the tilting direction of a control lever and the contact position.

Figure 2:
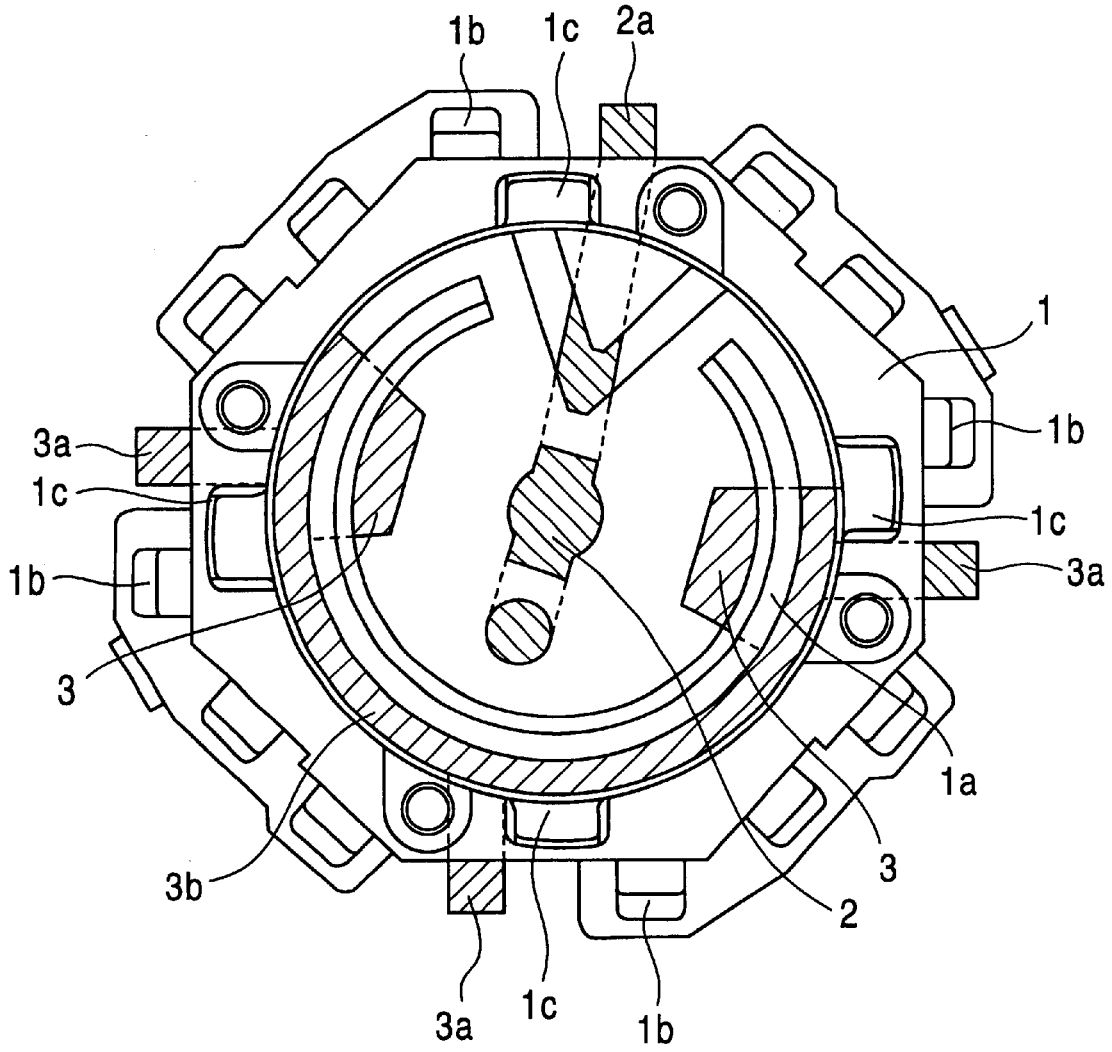
FIG. 2 is a top view of a housing in the multidirectional input device.

Referring to FIG. 2, a housing 1 made of synthetic resin is open at the top thereof, and is shaped like an octagon as viewed in plan. On the inner bottom face of the housing 1, a lower fixed contact 2 is disposed at the center, and two common contacts 3 are disposed on the periphery. The lower fixed contact 2 and the common contacts 3 project to the outside of the housing 1 so as to be terminals 2*a* and 3*a*, respectively. In FIG. 2, oblique lines and broken lines show the connection between the lower fixed contact 2 and the fixed terminal 2*a*, and the contact between the common contacts 3 and the common terminals 3*a*.

An arc-shaped projection la is also formed on the inner bottom face of the housing 1, centered on the lower fixed contact 2. As shown in FIG. 2, guide holes 1*b* are respectively formed in the outer side walls of the housing 1, and four cutout portions Ic are formed at intervals of 90° in the inner side walls on the open side of the housing 1.

On the inner bottom face of the housing 1, a dome-shaped lower movable contact plate 4 is also disposed, and the position thereof is limited by the projection 1*a*. The lower movable contact plate 4 is always in contact with the common contacts 3, and is separate from the lower fixed contact 2. The lower fixed contact 2 and the lower movable contact plate 4 constitute a normally-open switch S1. An elastic pressing member 5 is placed inside the projection 1*a* so as to face the center of the upper surface of the lower movable contact plate 4.

The open end of the housing 1 is covered with a cover member 7 made of synthetic resin (electrical insulator). The housing 1 and the cover member 7 define a storage space 8. An upper fixed contact 10 is outserted on the lower surface of the cover member 7, and the top end of a connecting member 9 having a plurality of mounting legs is put on the cover member 7. The mounting legs are extended downward along the outer side wall of the housing 1, and are bent inward at the bottom ends thereof, whereby the housing 1 and the cover member 7 are connected.

As shown in FIG. 4, the cover member 7 has a through hole 7*a* at the center, and four upper fixed contacts 10 are arranged around the through hole 7*a* at intervals of 90° in the circumferential direction. Each of the fixed contacts 10 has, at about the center thereof, a projection 10*b* that slightly projects downward. When an upper fixed contact 10 is outserted on the cover member 7, even if the exposed face of the fixed contact 10 is partly covered with resin due to variations in molding conditions or the like, the projection 10*b* allows the fixed contact 10 to project from the resin portion, and permits reliable contact with an upper movable contact plate 11. The upper fixed contacts 10 extend downward to be terminals 10*a*, respectively, and the terminals 10*a* are passed through the guide holes 1*b* (see FIGS. 1 and 2) of the housing 1.

The upper movable contact plate 11 is placed inside the storage space 8. Between the upper movable contact plate 11 and the inner bottom face of the housing 1, a conductive coil spring 12 is interposed and is positioned between the peripheral wall of the housing 1 and the projection 1*a*. The bottom end of the coil spring 12 is in contact with conductive portions 3*b* (arc-shaped diagonally shaded portion in FIG. 2) that connect the common contacts 3 and the common terminals 3*a*, and the common contacts 3 and the upper movable contact plate 11 are always electrically connected via the coil spring 12. The upper movable contact plate 11 is pressed against the upper fixed contacts 10 on the lower surface of the cover member 7 by the urging force of the coil spring 12. The upper fixed contacts 10 and the upper movable contact plate 11 form four normally-closed switches S2.

The upper movable contact plate 11 is outserted on a drive member 13 made of synthetic resin, and the top of the drive member 13 is fitted in the through hole 7*a* of the cover member 7. As shown in FIG. 3, the upper movable contact plate 11 is nearly rhombic, and is provided with four projections 11*a* spaced at intervals of 90° on the periphery thereof, and four edges 11*b* extending straight so as to link the projections 11*a*. The diagonally shaded portion in FIG. 3 is made of metal to serve as a conductive portion. The upper surfaces of the projections 11*a* are slightly tapered off toward the leading ends thereof. The projections 11*a* are inserted in the cutout portions 1*c* formed on the inner wall of the housing 1 (see FIG. 1), thereby preventing the turn in the circumferential direction.

When the upper movable contact plate 11 is tilted, such tapered upper surfaces of the projections 11*a* allow the straight edges 11*b* of the upper movable contact plate 11 to be brought into line contact with the lower surface of the cover member 7 without being interfered with by the projections 11*a*, as will be described later. Therefore, the tapered portions are formed for the purpose of escape, and the projections 11*a* have only the function of turn prevention.

The drive member 13 has an oval-shaped center hole 13*a* at the bottom, in which the base end portion of a control lever 14 made of metal is inserted. While the control lever 14 can move in the axial direction with respect to the center hole 13*a*, it is inhibited from turning in the circumferential direction, due to spline coupling with the oval portion of the center hole 13*a*. The top of the control lever 14 projects outside the cover member 7, and the bottom end thereof is in contact with the elastic pressing member 5.

Next, a description will be given of an input operation in this multidirectional input device. When the control lever 14 is placed in a neutral position shown in FIG. 1, the normally-open switch S1 is off because the lower movable contact plate 4 is separate from the lower fixed contact 2, and the four normally-closed switches S2 are on because the upper movable contact plate 11 is in contact with all the upper fixed contacts 10.

When the control lever 14 in the neutral position is tilted in an arbitrary direction, e.g., in the direction shown in FIG. 5, the upper movable contact plate 11 inclines on the upper fixed contact 10 serving as a fulcrum on the opposite side from the tilting direction, and is separated from the other upper fixed contacts 10. Therefore, the normally-closed switch S2 corresponding to the upper fixed contact serving as the fulcrum remains on, and the other normally-closed switches S2 are turned off.

By this tilting operation of the control lever 14, the bottom end of the control lever 14 presses the lower movable contact plate 4 via the pressing member 5. When the lower movable contact plate 4 is brought into contact with the lower fixed contact 2, the normally-open switch S1 is switched from off to on. Even after the normally-open switch S1 is turned on, the control lever 14 can further tilt till the projection 11*a* of the upper movable contact plate 11 abuts on the bottom of the cutout portion 1*c* (a state shown in FIG. 5). The overstroke during this is absorbed by compression deformation of the pressing member 5.

When the tilting force applied to the control lever 14 is removed, since the upper movable contact plate 11 returns to the initial state due to the urging force of the coil spring 12, the control lever 14 returns to the neutral position shown in FIG. 1, and all the four normally-closed switches S2 are turned on again. The pressing member 5 and the lower movable contact plate 4 also return to the initial state due to elasticity, and the lower movable contact plate 4 separates from the lower fixed contact 2, whereby the normally-open switch S1 is turned off again. This also applies to a case in which the control lever 14 is tilted in directions other than the direction shown in FIG. 5.

When the control lever 14 in the neutral position shown in FIG. 1 is pushed in, it is moved straight downward along the center hole 13*a* of the drive member 13, and presses the lower movable contact plate 4 via the pressing member 5, as shown in FIG. 6. Since the upper movable contact plate 11 and the drive member 13 do not move, all the four normally-closed switches S2 remain on. When the lower movable contact plate 4 makes contact with the lower fixed contact 2, the normally-open switch S1 is switched from off to on. By removing the pressing force applied to the control lever 14, the pressing member 5 and the lower movable contact plate 4 return to the initial state due to their own elasticity, and the lower movable contact plate 4 separates from the lower fixed contact 2, whereby the normally-open switch S1 is turned off again.

For example, when a microcomputer is connected to the terminal 2*a* of the lower fixed contact 2 and the terminals

10*a* of the upper fixed contacts 10, it can detect the tilting direction and the pushing operation of the control lever 14 based on on/off signals between the terminal 2*a* and the terminals 10*a*. That is, when the control lever 14 is in the neutral position, all the four normally-closed switches S2 are on, whereas the normally-open switch S1 is off, as described above. Therefore, the microcomputer fetches an off-signal from between the terminal 2*a* and the terminals 10*a*, and thereby determines that the control lever 14 is in a non-operation state.

When the control lever 14 is tilted in an arbitrary direction (see FIG. 5), since the normally-open switch S1 and one of the four normally-closed switches S2 are on, a conduction path, the lower fixed contact 2—the lower movable contact plate 4—the common contacts 3—the coil spring 12—the upper movable contact plate 11—the upper fixed contact 10, is formed between the terminal 2*a* and the on-state terminal 10*a*. Based on this on-signal, the microcomputer determines that the control lever 14 has been tilted in the opposite direction from the on-state upper fixed contact 10.

When the control lever 14 is pushed in the neutral position (see FIG. 6), since the normally-open switch S1 is turned on while all the four normally-closed switches S2 remain on, the microcomputer fetches on-signals from the terminal 2*a* and all the terminals 10*a*, and thereby determines that the control lever 14 has been pushed.

As another detecting method, it may be possible to connect the microcomputer to the terminal 2*a* of the lower fixed contact 2, the terminals 3*a* of the common contacts 3, and the terminals 10*a* of the upper fixed contacts 10. In this case, the microcomputer monitors the on/off state of the normally-open switch S1, and determines that the control lever 14 is in a non-operation state when an off-signals is obtained from between the terminal 2*a* and the terminals 3*a*.

When the microcomputer fetches an on-signal from between the terminal 2*a* and the terminals 3*a*, this on-signal triggers the microcomputer to monitor the on/off state of the normally-closed switches S2. When the terminals 3*a* and all the four terminals 10*a* are on, the microcomputer determines that the control lever 14 has been pushed. When an on-signal is output from between the terminals 3*a* and a specific terminal 10*a*, the microcomputer determines the tilting direction of the control lever 14 based on this on-signal.

FIG. 7 is an explanatory diagram showing the operation principle in a case in which the upper movable contact plate 11 is nearly rhombic as viewed in plan. When the control lever 14 is slightly tilted in the X-direction with a finger tip via a knob Z, as shown in FIG. 5, the upper movable contact plate 11 inclines on a point A. At this time, since the tilting direction (X-direction) and the direction of the fulcrum (point A) are not aligned with respect to the tilting center O of the control lever 14, the control lever 14 is unstable. Therefore, it is difficult to further tilt the control lever 14 in this direction only by a push with a finger tip (the operation shaft is not stable). When the control lever 14 is further tilted, the tilting direction is naturally corrected so that the fulcrum is stable, that is, so that the end (edge) of the upper movable contact plate 11 is in line contact with the cover member 7 on the line A–C. At the position where the normally-closed switch S1 is turned on, the upper movable contact plate 11 simultaneously make contact with the upper fixed contacts 10 at two points A and C. That is, a first switch and a second switch defined in the claims are simultaneously turned on/off.

More specifically, for example, even when the control lever 14 is tilted in the direction of 60°, the operation shaft is not stable in this direction, and is corrected to the direction of 45° where the end of the upper movable contact plate 11 makes line contact with the cover member 7. As a result, the upper fixed contacts 10 and the upper movable contact plate 11 make contact at two points A and C at almost the same time.

FIG. 8 is an explanatory diagram showing the tilting directions of the control lever 14, and the positions where the edge of the movable contact plate 11 and the surface of the cover member 7 are brought into contact with each other by the tilting. In FIG. 8, lower-case letters a to h designate the tilting directions of the control lever 14, and upper-case letters A to H designate the corresponding contact positions. That is, the movable contact plate 11 and the cover member 7 make contact at a point A, C, E, or G when the control lever 14 is tilted in the direction within the range a, c, e, or g, and make contact on a line B, D, F, or H when the control lever 14 is tilted in the direction within the range b, d, f, or h.

Figure 9:
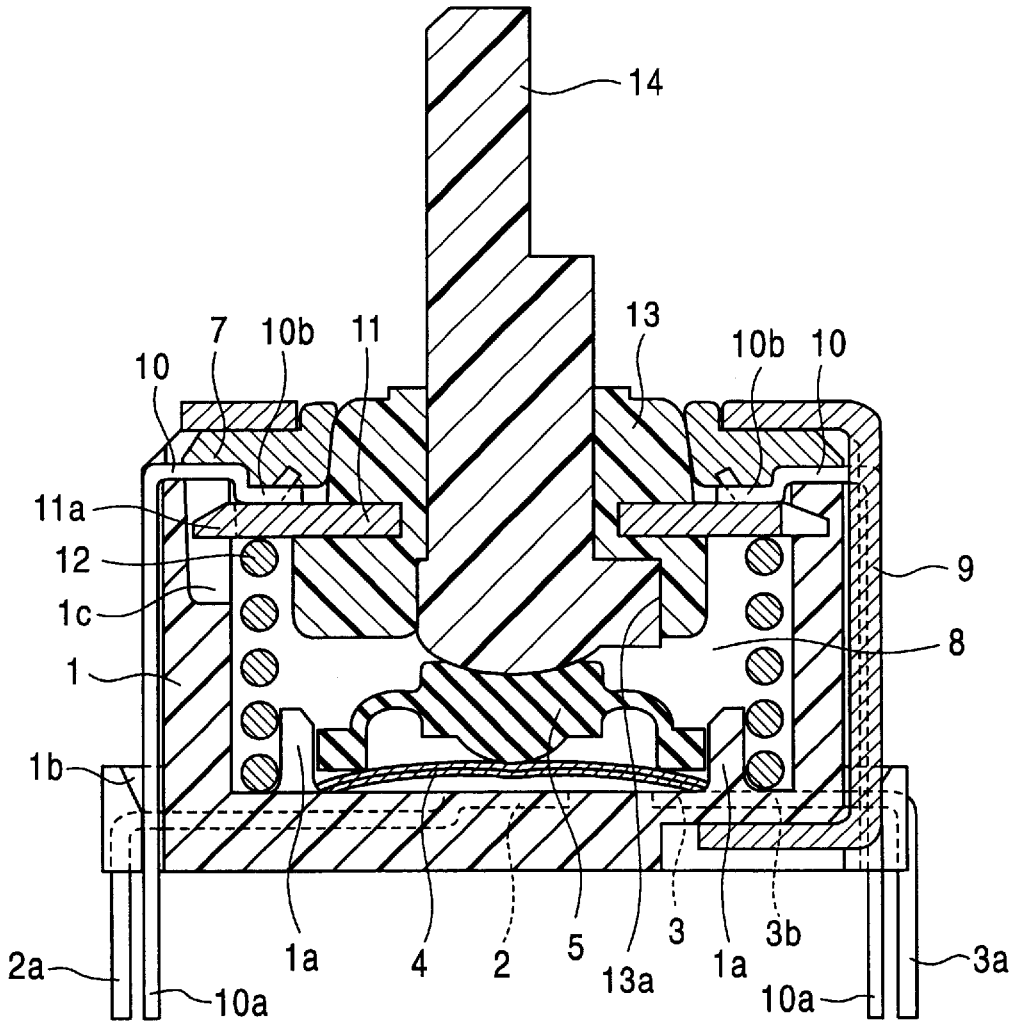
FIG. 9 is a sectional view of a multidirectional input device in a non-operation state according to a second embodiment of the present invention.
Figure 10:
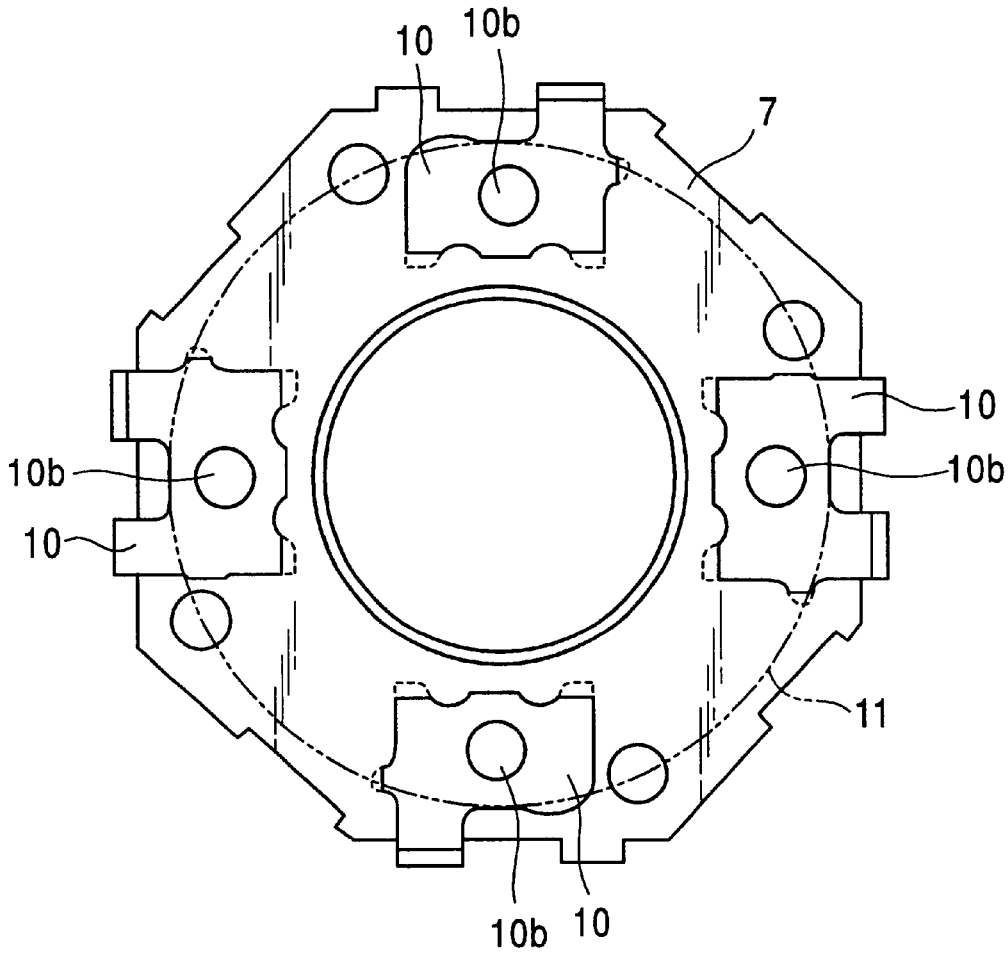
FIG. 10 is a bottom view of a cover member for holding upper fixed contacts in the multidirectional input device.

FIG. 9 is a sectional view of a multidirectional input device according to a second embodiment of the present invention, and FIG. 10 is a bottom view of a cover member for holding upper fixed contacts in the multidirectional input device. In this embodiment, as shown in FIG. 10, an upper movable contact plate 11 is circular, and projections 10*b* of upper fixed contacts 10, which are held at intervals of 90° on the periphery of a cover member 7, sufficiently project from the lower surface of the cover member 7.

In this configuration, even when a control lever 14 is tilted, for example, in the direction of 60°, the operation shaft is not stable in this direction, and is corrected to the direction of 45° where the surface of the upper movable contact plate 11 is supported by two projections 10*b* corresponding to the tilting direction. As a result, the upper movable contact plate 11 simultaneously makes contact with the two upper fixed contacts 10.

In this second embodiment, it may be possible to provide a rhombic insulating projection, whose vertexes are the slightly projecting projections, so that the surface of the upper movable contact plate 11 makes line contact with the ridge of the insulating projection, for example, when the control lever 14 is tilted in the direction of 60°.

Figure 11:
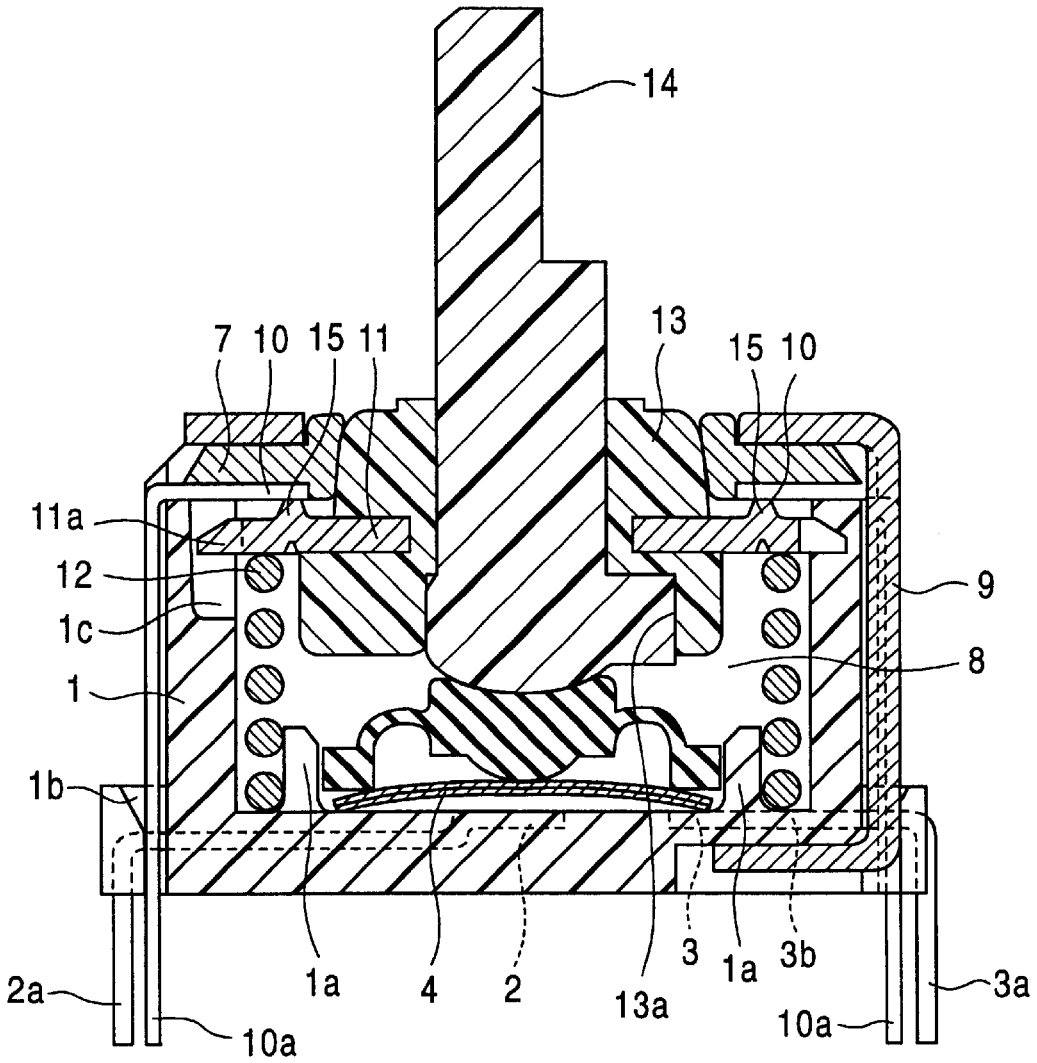
FIG. 11 is a sectional view of a multidirectional input device in a non-operation state according to a third embodiment of the present invention.
Figure 12:
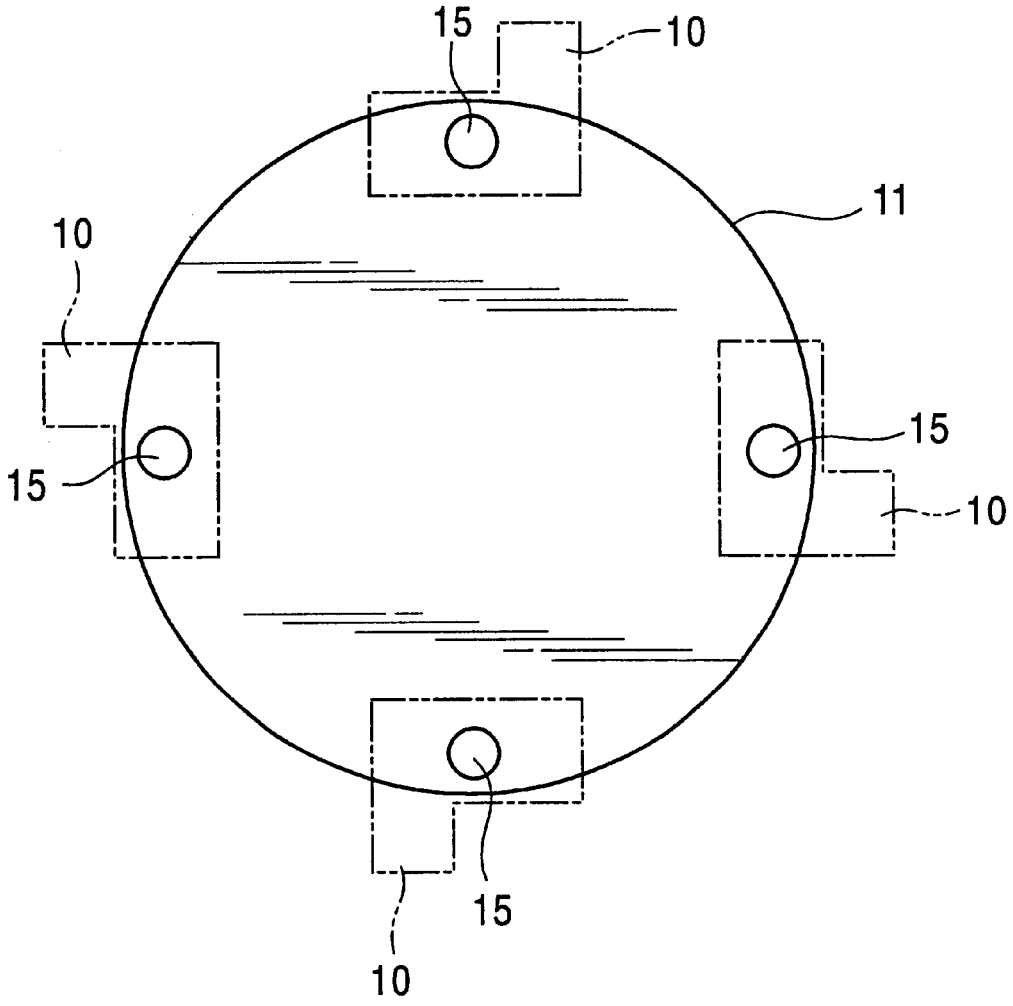
FIG. 12 is a top view of an upper movable contact plate in the multidirectional input device.

FIG. 11 is a sectional view of a multidirectional input device according to a third embodiment of the present invention, and FIG. 12 is a plan view of an upper movable contact plate in the multidirectional input device. In this embodiment, four projections 15 are formed at intervals of 90° near the outer periphery of the upper surface of an upper movable contact plate 11, and the upper movable contact plate 11 is placed to face four upper fixed contacts 10.

In this configuration, even when a control lever 14 is tilted, for example, in the direction of 60° the operation shaft is not stable in this direction, and is corrected to the direction of 45° where two projections 15 corresponding to the tilting direction of the upper movable contact plate 11 make contact with the upper fixed contacts 10. As a result, the upper fixed contacts 10 simultaneously make contact with the upper movable contact plate 11 at two points.

Figure 13:
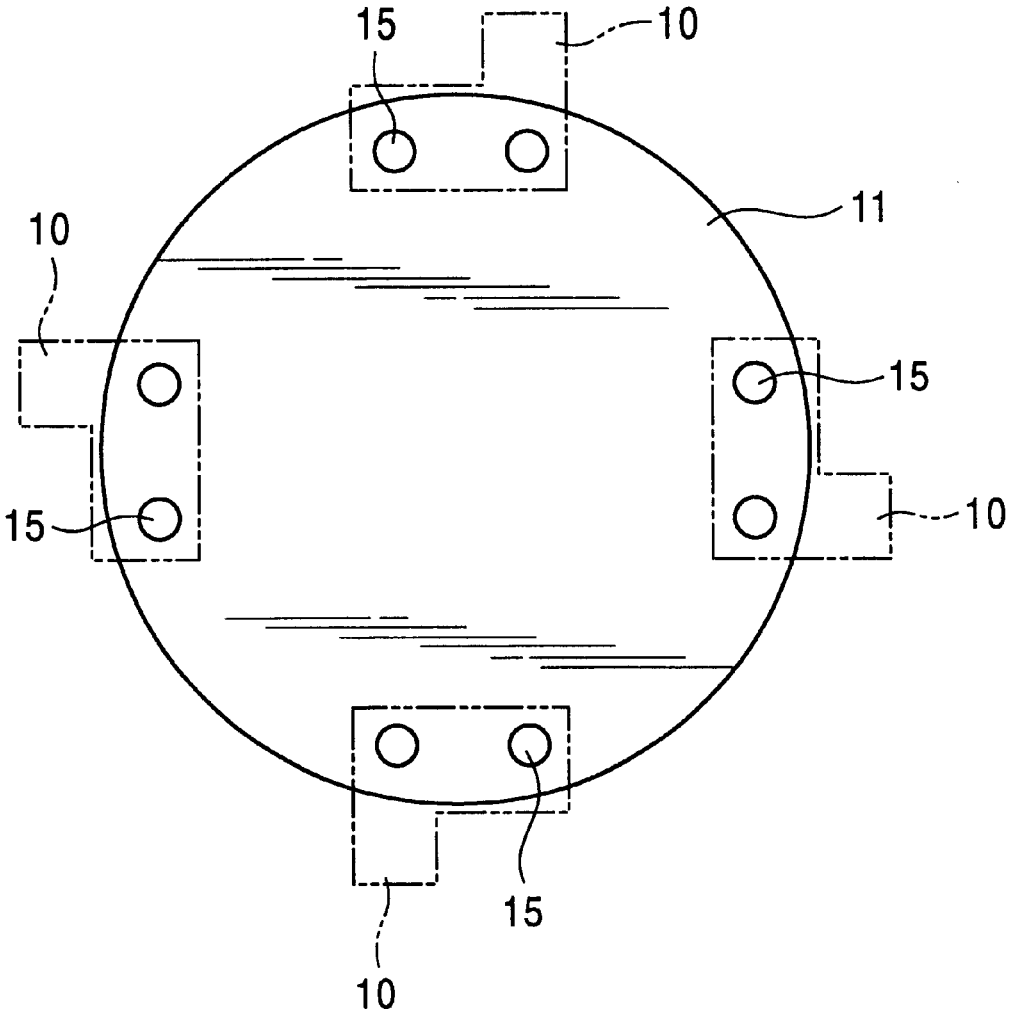
FIG. 13 is a top view of an upper movable contact plate in a multidirectional input device according to a fourth embodiment of the present invention.

FIG. 13 is a plan view of an upper movable contact plate in a multidirectional input device according to a fourth embodiment of the present invention. In this embodiment, two projections 15 are formed near the outer periphery of the upper surface of the upper movable contact plate 11 each at intervals of 90°, and the upper movable contact plate 11 is placed to face upper fixed contacts 10. While the projections 15 are round in this embodiment, they may be shaped like an elongated rib.

Figure 14:
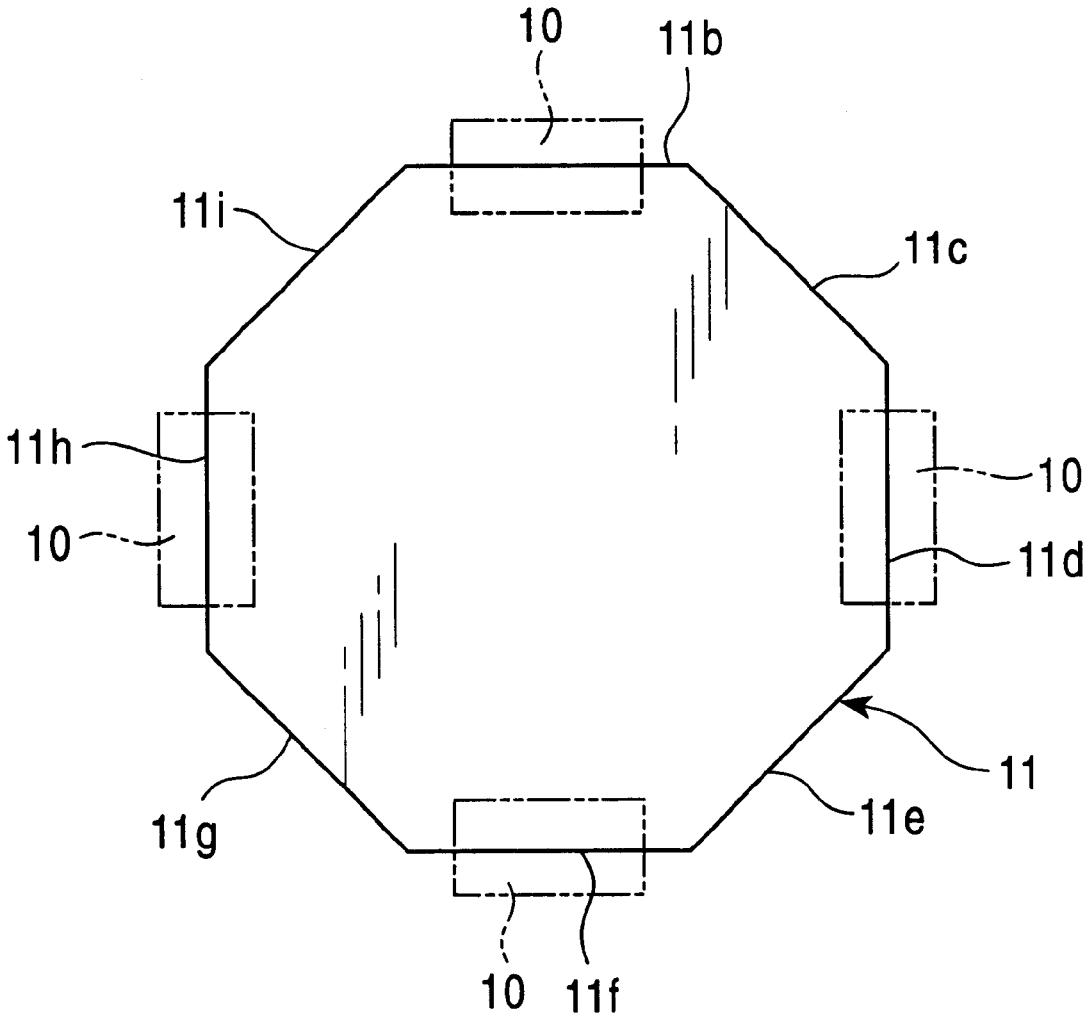
FIG. 14 is a top view of an upper movable contact plate in a multidirectional input device according to a fifth embodiment of the present invention.

FIG. 14 is a plan view of an upper movable contact plate in a multidirectional input device according to a fifth embodiment of the present invention. In this embodiment, an upper movable contact plate 11 is shaped like an octagon, as viewed in plan. Edges 11*b*, 11*d*, 11*f*, and 11*h* of the upper movable contact plate 11 are in line contact with upper fixed contacts 10 held on a cover member 7 at intervals of 90°, and the other edges 11*c*, 11*e*, 11*g*, and 11*i* are in line contact with the cover member 7.

Figure 15:
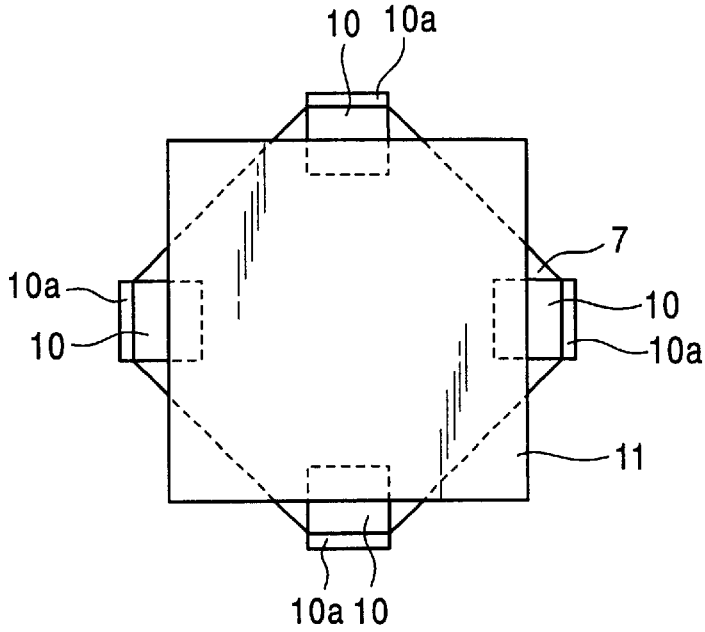
FIG. 15 is a bottom view showing the overlapping state of an upper movable contact plate and a cover member in a multidirectional input device according to a sixth embodiment of the present invention.

FIG. 15 is a bottom view showing the overlapping state of an upper movable contact plate and a cover member in a multidirectional input device according to a sixth embodiment of the present invention. In this embodiment, both a cover member 7 and an upper movable contact plate 11 are rectangular, as viewed in plan, and overlap with each other while being shifted by 45°, as shown In FIG. 15. Upper fixed contacts 10 are held at the corners of the cover member 7. When the upper movable contact plate 11 is inclined, it is brought into line contact with the cover member 7.

Figure 16:
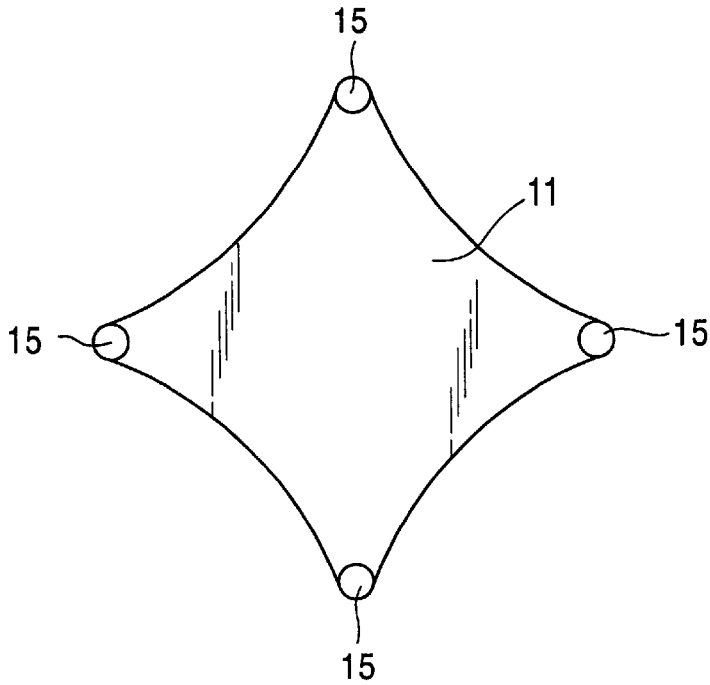
FIG. 16 is a plan view of an upper movable contact plate in a multidirectional input device according to a seventh embodiment of the present invention.
Figure 17:
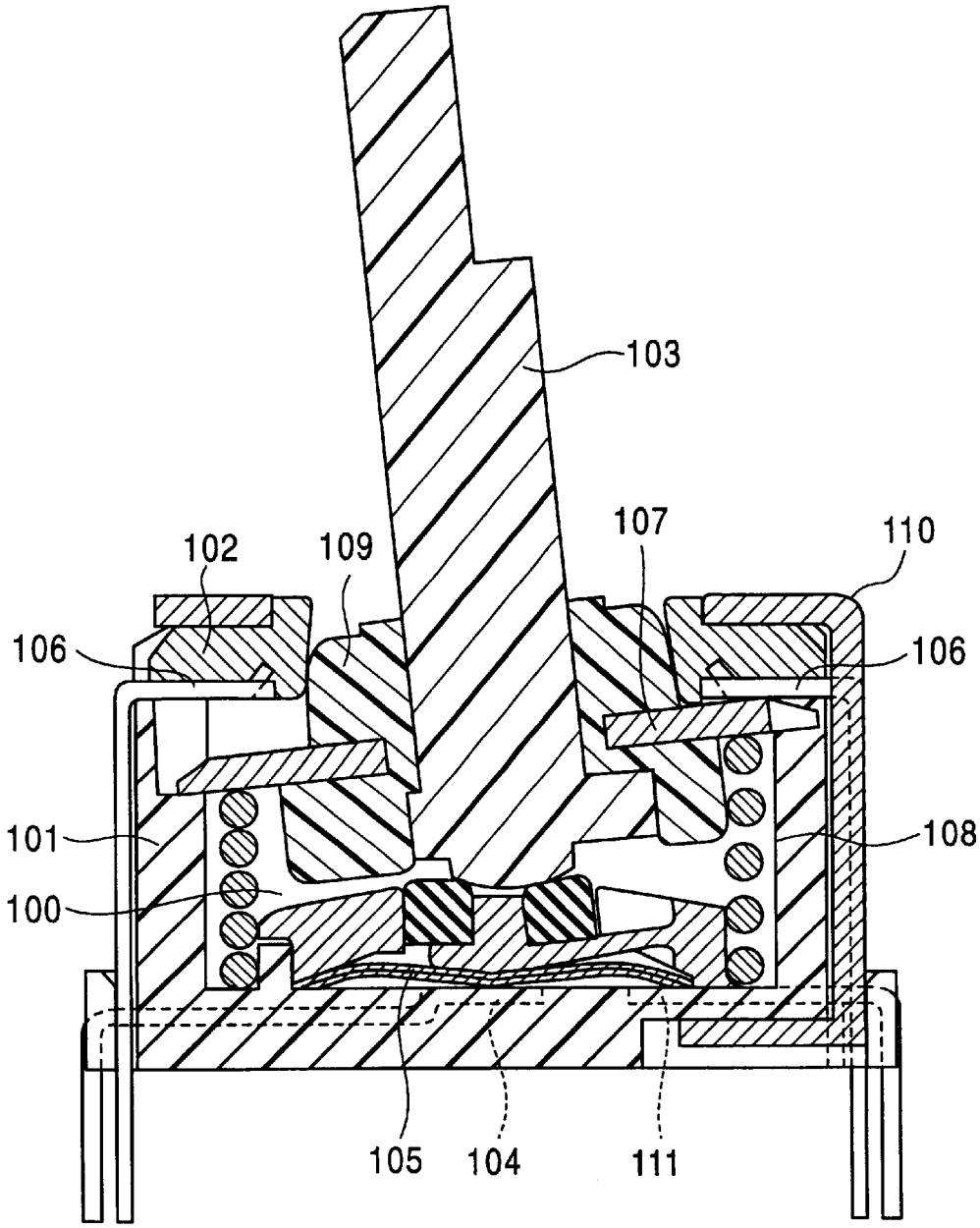
FIG. 17 is a sectional view illustrating a tilting operation in a multidirectional input device that has been proposed hitherto.
Figure 18:
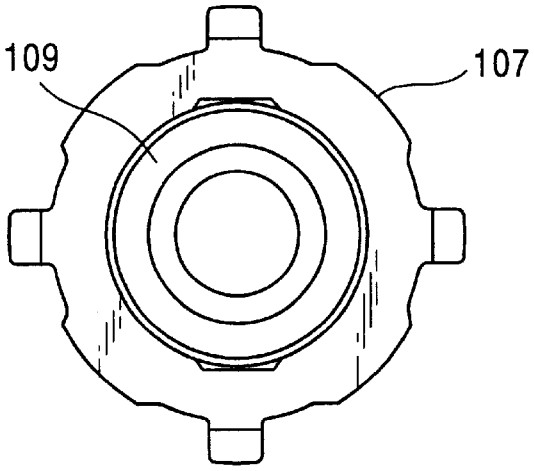
FIG. 18 is a plan view of an upper movable contact plate in the multidirectional input device.
Figure 19:
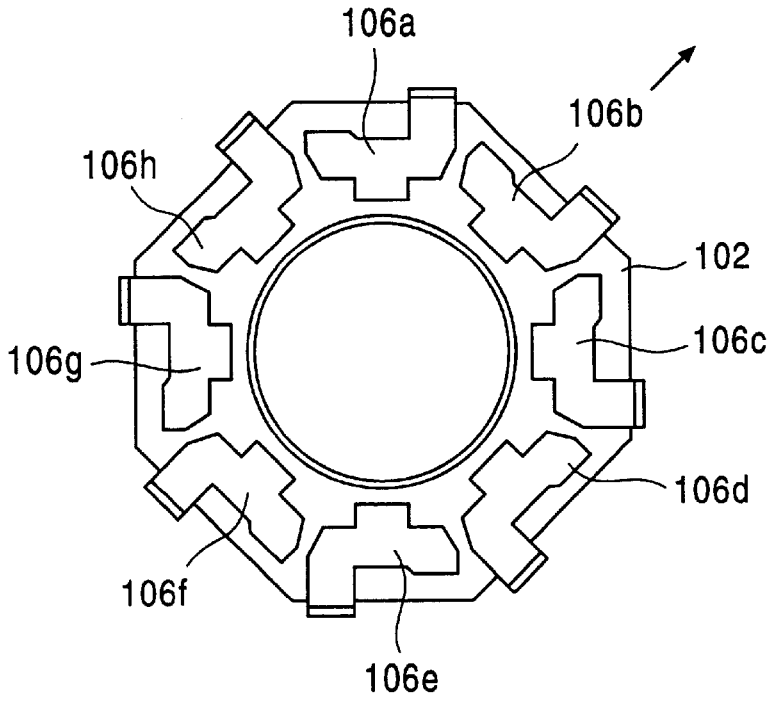
FIG. 19 is a bottom view of a cover member for holding upper fixed contacts in the multidirectional input device.

FIG. 16 is a plan view of an upper movable contact plate in a multidirectional input device according to a seventh embodiment of the present invention. In this embodiment, an upper movable contact plate 11 is rhombic, as viewed in plan. The upper movable contact plate 11 is slightly curved inward at the edges, and is provided with projections 15 at the corners, respectively. When the upper movable contact plate 11 inclines, it makes contact with a cover member 7 at two points. The projections 15 are not always necessary.

In FIGS. 10 and 12 to 16, the illustration of turn-preventive projections 11*a* of the upper movable contact plate 11 is omitted.

While the multidirectional input device having the normally-open switch S1 and the normally-closed switches S2 has been described in the above embodiments, the present invention may be applied to a multidirectional input device in which four tact switches are arranged at the bottom of the housing, and are directly pressed by a flange having an operation shaft.

According to the present invention, as described above, when the first switch and the second switch are simultaneously turned on/off in response to the tilting of the control lever, the tilting flange member and the support member make line contact with each other, or make contact at two points. This naturally corrects the operation shaft of the control lever to a direction such as to stabilize the operation shaft during the process of tilting. As a result, it is possible to simultaneously turn the first switch and the second switch on/off, and to thereby provide a reliable multidirectional input device in which detection accuracy in the oblique direction is high.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A multidirectional input device, comprising:

a control lever held to tilt and rise and not to turn on an axis thereof;

a flange-shaped movable contact member formed in said control lever so as to tilt and rise in combination with tilting and rising of said control lever, and so as not to turn on said axis of said control lever, said flange-shaped movable contact member being shaped like a quadrangle in plan view;

a fixed contact support member having a flat surface and fixed opposed to said flange-shaped movable contact member;

a first switch having a first fixed contact disposed on a surface of said fixed contact support member, said first switch being turned on/off in response to contact and separation between said first fixed contact and said flange-shaped movable contact member according to a first tilting and rising movement of said control lever with respect to said first fixed contact; and a second switch having a second fixed contact disposed adjacent to and at a predetermined distance from said first fixed contact on said surface of said fixed contact support member, said second switch being turned on/off in response to contact and separation between said second fixed contact and said flange-shaped movable contact member according to a second tilting and rising movement of said control lever with respect to said second fixed contact, wherein said first fixed contact of said first switch and said second fixed contact of said second switch are disposed at positions corresponding to vertexes of said quadrangle of said flange-shaped movable contact member, and wherein said first fixed contact and said second fixed contact are placed so that a side of said flange-shaped movable contact member is brought into linear contact with said surface of said fixed contact support member when said control lever tilts and rises in a predetermined direction between a direction of said first tilting and rising movement and a direction of said second tilting and rising movement, and is simultaneously contacted with and separated from said corresponding vertexes of said flange-shaped movable contact member.

2. A multidirectional input device according to claim 1, wherein said flange-shaped movable contact member is formed of a nearly rhombic movable contact plate, and said fixed contact support member is made of an electric insulating material.

3. A multidirectional input device according to claim 1, wherein an elastic member is provided to urge said flange-shaped movable contact member toward said fixed contact support member so that said flange-shaped movable contact member can tilt toward and rise from the side of said fixed contact support member.

4. A multidirectional input device according to claim 1, wherein said flange-shaped movable contact member is rhombic in plan view.

5. A multidirectional input device, comprising:

a control lever held to tilt and rise and not to turn on an axis thereof;

a flange-shaped movable contact member formed in said control lever so as to tilt and rise in combination with tilting and rising of said control lever, and so as not to turn on said axis of said control lever, said flange-shaped movable contact member being shaped like a circle in plan view;

a fixed contact support member having a flat surface and fixed opposed to said flange-shaped movable contact member;

a first switch having a first fixed contact disposed on a surface of said fixed contact support member, said first switch being turned on/off in response to contact and separation between said first fixed contact and said flange-shaped movable contact member by a first tilting and rising movement of said control lever with respect to said first fixed contact; and a second switch having a second fixed contact disposed adjacent to and at a predetermined distance from said first fixed contact on said surface of said fixed contact support member, said second switch being turned on/off in response to contact and separation between said second fixed contact and said flange-shaped movable contact member by a second tilting and rising movement of said control lever with respect to said second fixed contact, wherein each of said first fixed contact and said second fixed contact has at least one projection so as to simultaneously contact and separate said flange-shaped movable contact member with and from said first fixed contact and said second fixed contact when said control lever tilts and rises in a predetermined direction between a direction of said first tilting and rising movement and a direction of said second tilting and rising movement.

6. A multidirectional input device according to claim 5, wherein said projections formed on said first fixed contact and said second fixed contact have a round tip.

7. A multidirectional input device according to claim 5, wherein an elastic member is provided to urge said flange-shaped movable contact member toward said fixed contact support member so that said flange-shaped movable contact member can tilt and rise relative to said fixed contact support member.

8. A multidirectional input device, comprising:

a control lever held to tilt and rise and not to turn on an axis thereof;

a flange-shaped movable contact member formed in said control lever so as to tilt and rise in combination with tilting and rising of said control lever, and so as not to turn on said axis of said control lever, said flange-shaped movable contact member being shaped like a circle in plan view;

a fixed contact support member fixed opposed to said flange-shaped movable contact member;

a first switch having a first fixed contact disposed on a surface of said fixed contact support member, said first switch being turned on/off in response to contact and separation between said first fixed contact and said flange-shaped movable contact member by a first tilting and rising movement of said control lever with respect to said first fixed contact; and a second switch having a second fixed contact disposed adjacent to and at a predetermined distance from said first fixed contact on said surface of said fixed contact support member, said second switch being turned on/off in response to contact and separation between said second fixed contact and said flange-shaped movable contact member by a second tilting and rising movement of said control lever with respect to said second fixed contact, wherein portions of said flange-shaped movable contact member opposing said first fixed contact and said second fixed contact respectively have at least one projection which simultaneously contacts with and separates from said first fixed contact and said second fixed contact when said control lever tilts and rises in a predetermined direction between a direction of said first tilting and rising movement and a direction of said second tilting and rising movement.

9. A multidirectional input device according to claim 8, wherein said projections formed on said portions of said flange-shaped movable contact member first have a round tip.

10. A multidirectional input device according to claim 8, wherein an elastic member is provided to urge said flange-shaped movable contact member toward said fixed contact support member so that said flange-shaped movable contact member can tilt and rise relative to said fixed contact support member.

11. A multidirectional input device, comprising:

a control lever held to tilt and rise and not to turn on an axis thereof;

a flange-shaped movable contact member formed in said control lever so as to tilt and rise in combination with tilting and rising of said control lever, and so as not to turn on said axis of said control lever, said flange-shaped movable contact member being shaped like a polygon in plan view;

a fixed contact support member having a flat surface and fixed opposed to said flange-shaped movable contact member;

a first switch having a first fixed contact disposed on a surface of said fixed contact support member, said first switch being turned on/off in response to contact and separation between said first fixed contact and said flange-shaped movable contact member by a first tilting and rising movement of said control lever with respect to said first fixed contact; and a second switch having a second fixed contact disposed adjacent to and at a predetermined distance from said first fixed contact on said surface of said fixed contact support member, said second switch being turned on/off in response to contact and separation between said second fixed contact and said flange-shaped movable contact member by a second tilting and rising movement of said control lever with respect to said second fixed contact, wherein predetermined edges of said polygon of said flange-shaped movable contact member are respectively placed opposed to said first fixed contact of said first switch and said second fixed contact of said second switch so that they are brought into linear contact with and are separated from first and second fixed contacts in response to tilting and rising of said control lever in a direction of said first tilting and rising movement and in a direction of said second tilting and rising movement, and wherein an edge of said flange-shaped movable contact member between said edge opposing said first fixed contact and said edge opposing said second fixed contact is placed so as to be brought into linear contact with said surface of said fixed contact support member and to be simultaneously contacted with and separated from said first fixed contact and said second fixed contact when said control lever tilts and rises in a predetermined direction between the direction of said first tilting and rising movement and the direction of said second tilting and rising movement.

12. A multidirectional input device according to claim 11, wherein said flange-shaped movable contact member is shaped like an octagon in plan view.

13. A multidirectional input device according to claim 11, wherein an elastic member is provided to urge said flange-shaped movable contact member toward said fixed contact support member so that said flange-shaped movable contact member can tilt and rise relative to said fixed contact support member.

14. A multidirectional input device, comprising:

a control lever held to tilt and rise and not to turn on an axis thereof;

a flange-shaped movable contact member formed in said control lever so as to tilt and rise in combination with tilting and rising of said control lever, and so as not to turn on said axis of said control lever, said flange-shaped movable contact member being shaped like a square in plan view;

a fixed contact support member having a flat surface, fixed opposed to said flange-shaped movable contact member, shaped like a square equivalent to the outer shape of said flange-shaped movable contact member, and overlapping with said flange-shaped movable contact member while being shifted by 45°;

a first switch having a first fixed contact disposed on a surface of said fixed contact support member, said first switch being turned on/off in response to contact and separation between said first fixed contact and said flange-shaped movable contact member by a first tilting and rising movement of said control lever with respect to said first fixed contact; and a second switch having a second fixed contact disposed adjacent to and at a predetermined distance from said first fixed contact on said surface of said fixed contact support member, said second switch being turned on/off in response to contact and separation between said second fixed contact and said flange-shaped movable contact member by a second tilting and rising movement of said control lever with respect to said second fixed contact, wherein said first fixed contact of said first switch and said second fixed contact of said second switch are disposed at positions corresponding to sides of said square of said flange-shaped movable contact member, and wherein said first fixed contact and said second fixed contact are placed so as to simultaneously contact with and separate from said flange-shaped movable contact member and so that said flange-shaped movable contact member is brought into linear contact and is separated from edges of said square of said fixed contact support member when said control lever tilts and rises in a predetermined direction between a direction of said first tilting and rising movement and a direction of said second tilting and rising movement.

15. A multidirectional input device according to claim 14, wherein an elastic member is provided to urge said flange-shaped movable contact member toward said fixed contact support member so that said flange-shaped movable contact member can tilt and rise relative to said fixed contact support member.

16. A multidirectional input device, comprising:

a control lever held to tilt and rise and not to turn on an axis thereof;

a flange-shaped movable contact member formed in said control lever so as to tilt and rise in combination with tilting and rising of said control lever, and so as not to turn on said axis of said control lever, said flange-shaped movable contact member being shaped nearly like a quadrangle with edges curved inwardly in plan view;

a fixed contact support member fixed opposed to said flange-shaped movable contact member;

a first switch having a first fixed contact disposed on a surface of said fixed contact support member, said first switch being turned on/off in response to contact and separation between said first fixed contact and said flange-shaped movable contact member by a first tilting and rising movement of said control lever with respect to said first fixed contact; and a second switch having a second fixed contact disposed adjacent to and at a predetermined distance from said first fixed contact on said surface of said fixed contact support member, said second switch being turned on/off in response to contact and separation between said second fixed contact and said flange-shaped movable contact member by a second tilting and rising movement of said control lever with respect to said second fixed contact, wherein said first fixed contact of said first switch and said second fixed contact of said second switch are disposed at positions corresponding to vertexes of said quadrangle of said flange-shaped movable contact member, and wherein said first fixed contact and said second fixed contact are placed so that flange-shaped movable contact member simultaneously contacts with and separates from said first fixed contact and said second fixed contact when said control lever tilts and rises in a predetermined direction between a direction of said first tilting and rising movement and a direction of said second tilting and rising movement.

17. A multidirectional input device according to claim 16, wherein an elastic member is provided to urge said flange-shaped movable contact member toward said fixed contact support member so that said flange-shaped movable contact member can tilt and rise relative to said fixed contact support member.

* * * * *